US006986182B2

(12) United States Patent
Mossbeck

(10) Patent No.: US 6,986,182 B2
(45) Date of Patent: Jan. 17, 2006

(54) POCKETED BEDDING OR SEATING PRODUCT HAVING INFLATABLE MEMBERS

(75) Inventor: Niels S. Mossbeck, Carthage, MO (US)

(73) Assignee: L&P Property Management Company

( * ) Notice: Subject to any disclaimer, the term of this patent is extended or adjusted under 35 U.S.C. 154(b) by 0 days.

(21) Appl. No.: 10/864,924

(22) Filed: Jun. 10, 2004

(65) Prior Publication Data

US 2005/0273939 A1 Dec. 15, 2005

(51) Int. Cl.
*A47C 27/06* (2006.01)

(52) U.S. Cl. ..... 5/727; 5/719; 5/720; 267/81; 267/95

(58) Field of Classification Search ..... 5/709, 5/710, 716, 719, 720, 727
See application file for complete search history.

(56) References Cited

U.S. PATENT DOCUMENTS 3,919,730 A 11/1975 Regan
4,439,977 A 4/1984 Stumpf
4,827,546 A 5/1989 Cvetkovic
5,105,488 A * 4/1992 Hutchinson et al. ..... 5/710
5,113,539 A 5/1992 Strell
5,636,396 A 6/1997 Workman et al.
6,098,223 A 8/2000 Larson
6,101,697 A 8/2000 Stumpf et al.
6,143,122 A 11/2000 Mossbeck et al.
6,256,820 B1 7/2001 Moser et al.
6,317,912 B1 11/2001 Graebe et al.
6,487,738 B1 * 12/2002 Graebe ..... 5/719
6,684,435 B1 2/2004 Wells

* cited by examiner

*Primary Examiner*—Michael Trettel
(74) *Attorney, Agent, or Firm*—Wood, Herron & Evans, LLP

(57) ABSTRACT

A bedding or seating product comprises a pocketed spring assembly having a plurality of parallel strings of springs joined to each other. Each of said strings of springs comprises a row of interconnected pockets, each of the pockets containing at least one spring encased in a fabric pocket. An inflatable member is sandwiched between a lower scrim sheet and some strings of springs. When inflated, the inflatable member preloads select areas of the product.

23 Claims, 5 Drawing Sheets

POCKETED BEDDING OR SEATING PRODUCT HAVING INFLATABLE MEMBERS

FIELD OF THE INVENTION

This invention relates generally to spring assemblies for use in mattresses, spring upholstered furniture and the like and, more particularly, to a posturized pocketed coil spring assembly and associated method of manufacturing such an assembly.

BACKGROUND OF THE INVENTION

A well known type of bedding or seating product comprises a spring assembly which includes a number of discrete coil springs, each of which is enclosed in a fabric pocket in a length of folded fabric material. Longitudinal axes of the coil springs are generally parallel with one another so that the top and bottom end turns of the coil springs define top and bottom faces of the spring assembly. A row of such pocketed springs is known in the industry as a string of pocketed springs. A bedding or seating product can be fabricated from such strings of pocketed springs by binding or adhering the individual rows or strings of pocketed springs together to form a spring assembly which may be padded and encased in an upholstered covering. U.S. Pat. No. 6,143,122, which is fully incorporated by reference herein, discloses one such method of adhesively bonding strings of pocketed springs together to form a spring assembly.

This type of spring assembly is commonly referred to as a pocketed spring assembly due to the fact that each spring is contained within an individual pocket of fabric material. The construction of strings of pocketed coil springs is well known in the art and, for example, is disclosed in U.S. Pat. No. 4,439,977, which is hereby incorporated by reference in its entirety. The system disclosed in that patent includes a spring coiler which forms a coil spring which is subsequently compressed and inserted between the plies of folded pocketing fabric material. Other systems for manufacturing pocketed coil spring assemblies are disclosed in PCT Patent Application No. WO94/18116 and U.S. Pat. No. 6,101,697, each of which are expressly incorporated herein by reference.

Pocketed spring assemblies are generally recognized to have a unique and particular luxurious feel to them and mattresses manufactured of such pocketed spring assemblies provide a feeling of softness without lacking spring resilience or support. Mattresses and similar articles constructed of pocketed spring assemblies are often considered a high-end type of product because of the added benefits and features of the pocketed coil springs. Mattresses and the like of this type can be more costly to manufacture and assemble as a result of the considerable amount of time and labor which is involved in their manufacture, together with the fact that the method of fabrication and assembly of such pocketed spring assemblies can be complicated, particularly in an automated process.

One particular aspect of the commercial production of pocketed spring assemblies and the associated mattresses or the like is the handling of such assemblies in the factories. The manipulation and movement of the various components of the spring assembly from station to station or various areas of the factories can be cumbersome, difficult and inconvenient depending on the particular production facilities and assembly techniques.

Additionally, while pocketed spring assemblies are considered to provide a combination of softness and support, the ability to economically posturize a spring assembly or mattress of pocketed spring coils has heretofore been difficult. Posturization provides multiple zones or sections of differing firmnesses within a product such as a mattress. For example, the middle regions of the mattress, which typically support a person's torso, often require a firmer more resilient support while other areas of the mattress which support the feet and head of a person require a softer feel.

One known method of posturizing a pocketed spring assembly has been to incorporate springs made of different gauge wire into the strings of springs. For example, the springs incorporated into the strings of springs within certain sections or zones of the spring assembly are made of a larger gauge wire than the springs incorporated into the strings of springs of the other sections or zones of the spring assembly. U.S. Pat. No. 6,173,464 discloses this concept, albeit with continuous bands of springs as opposed to individual springs.

Another known method of posturizing a pocketed spring assembly has been to incorporate multiple springs into select pockets of a strings of springs. For example, within certain sections or zones of the pocketed spring assembly multiple springs are inserted into the pockets of the strings of springs to increase the firmness of those sections or zones of the product relative to the other sections or zones of the product. U.S. Pat. No. 6,684,435 discloses a method of posturizing a pocketed spring product in this manner. One difficulty with making such a posturized pocketed spring assembly is that additional springs are required, thereby increasing the cost of the product.

Therefore, there is a need for a posturized pocketed spring assembly and associated method of manufacture which offers the advantages of posturization of the spring assembly without the higher manufacturing costs, production difficulties and inefficiencies associated with known posturized pocketed spring assemblies.

SUMMARY OF THE INVENTION

The invention of this application which accomplishes these and other objectives is a bedding or seating product comprising a pocketed coil spring assembly surrounded in an upholstered covering and associated method of manufacture.

The pocketed spring assembly comprises a plurality of parallel strings of springs joined to each other, each of the strings of springs comprising a row of interconnected pockets. Each of the pockets contains at least one spring encased in fabric. Each of the springs is preferably a coil spring having an upper end turn, a lower end turn and a plurality of central convolutions between the end turns. However, any other type of spring may be used with the present invention. Preferably, each string of springs is made of one piece of fabric folded and welded into a plurality of pockets, each of the pockets containing at least one coil spring. Opposed plies of the string of springs may be joined be sewing, gluing or sonic welding, as know in the art.

In each of the embodiments of the present invention, the pocketed spring assembly is posturized, meaning select sections, areas or regions of the pocketed spring assembly are firmer than other sections, areas or regions of the pocketed spring assembly. This difference in firmness is attributable to incorporating inflatable bellows or members within the different sections, areas or regions of the pocketed spring assembly. The inflatable members are preferably pneumatic and connected to an air pump. However, other fluids may be used if desired to inflate the members to a desired pressure.

In one preferred embodiment of the present invention, inflatable members are sandwiched between select strings of springs and a lower or bottom scrim sheet. Other strings of springs not having an inflatable member underneath them are secured to the bottom or lower scrim sheet. The upper surfaces of the inflatable members are secured to the lower surfaces of the select strings of springs while the lower surfaces of the inflatable members are secured to the lower scrim sheet. The effect of inflating the members is to preload the pocketed springs thereabove. Consequently, areas of the pocketed spring assembly in which the members are inflated to preload the springs thereabove are firmer than the areas of the pocketed spring assembly having no preloaded coil springs. The degree to which the members are inflated may be varied with the result being that the pocketed springs thereabove may be preloaded to varying degrees.

One or more layers of padding may be placed on top of the pocketed coil spring assembly. An upholstered covering surrounds the padding and pocketed spring assembly. At least one border wire may be secured to the spring assembly, if desired.

In several preferred embodiments of the present invention, some of the strings of springs have pockets within which there is located a first or tall spring of a first uncompressed height surrounding a second or short spring of a second uncompressed height less than the first uncompressed height. The second or short spring may be individually pocketed. This type of product is known in the industry as a "Joey" product. In such a preferred embodiment, when the inflatable members of the present invention are inflated underneath such strings of springs, both the first and the second pocketed springs inside the fabric pockets are raised against the top of the fabric pockets, thereby increasing the firmness of these strings of springs.

In several preferred embodiments of the present invention, the product is divided into longitudinally spaced regions of differing firmnesses. In one such preferred embodiment, the product has three longitudinally spaced regions of differing firmnesses, a head section, a center section and a foot section. Due the presence of inflatable members in the center section of the product, the firmness of the center section may be increased relative to the firmness of the head and foot sections when the inflatable pneumatic members are inflated to preload select pocketed springs in the center section.

In accordance with the present invention, a bedding or seating product may have any number of sections of different firmness oriented longitudinally or transversely when the pneumatic inflatable members are inflated to the desired degree and the pocketed coil springs above the pneumatic inflatable members preloaded.

In any of the embodiments of the present invention, the inflatable members may be located to create either a one-sided or a two-sided product. Depending upon the desired posturization, the strings of springs may be oriented transversely or longitudinally. Depending upon the desired application, any number of pocketed springs within a string of springs may be preloaded by at least one inflated member or bladder. Alternatively, only select pocketed springs within a string of springs may be preloaded for improved firmness in select areas.

The method of manufacturing the posturized pocketed spring assembly of the present invention varies depending upon the desired posturization. However, in each of the applications of the present invention multiple strings of springs are secured together to form a pocketed spring assembly. One or more inflatable members is secured below one or more portions of the pocketed spring assembly. The inflatable members are inflated a desired amount to preload select pocketed springs which results in increased firmness in those areas of the pocketed spring assembly.

In one method of manufacturing a posturized bedding or seating product in accordance with the present invention, the strings of springs are secured to each other along the side surfaces of the pockets within the strings of springs. The pockets of some of the strings of springs are secured to a lower scrim sheet. The pockets of other strings of springs are secured to an inflatable member operatively coupled to an air supply. More specifically, the inflatable members are secured to the underside of the fabric of the strings of springs. Each of these inflatable members is further secured to the lower scrim sheet.

In each of the preferred embodiments of the present invention, the process of inflating members secured underneath the pocketed springs of some strings of springs results in a posturized pocketed spring assembly due to some of the pocketed springs being preloaded. Such a product may be made in accordance with a customer's needs and desires quickly and easily.

These objectives and features of the invention will become more readily apparent from the following detailed description taken in conjunction with the accompanying drawings in which.

DETAILED DESCRIPTION OF THE INVENTION

Figure 1:
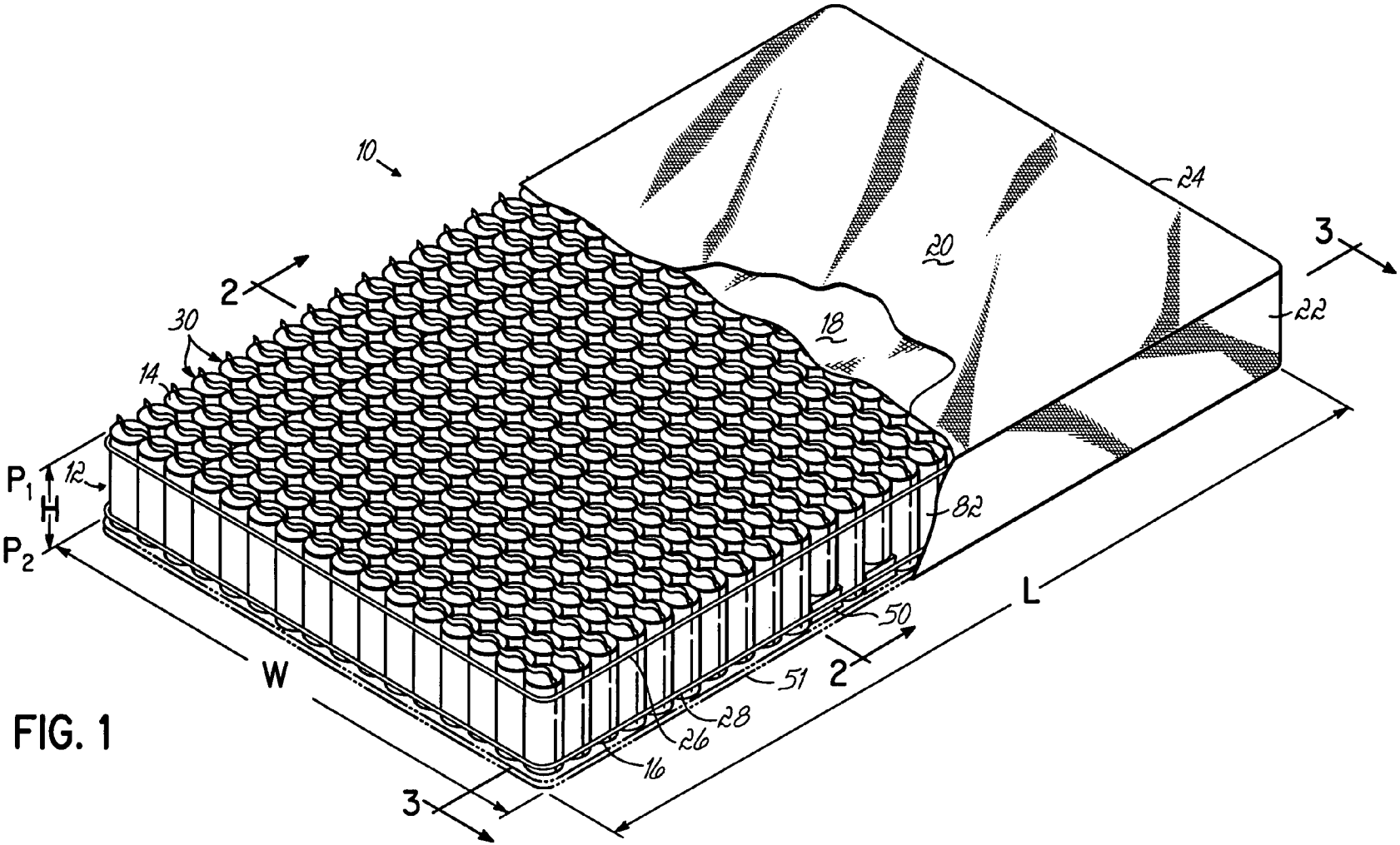
FIG. 1 is a perspective view of a bedding product made in accordance with one aspect of the invention comprising a pocketed spring assembly in which the strings of springs extend transversely.

Referring to the drawings, particularly to FIG. 1, there is illustrated a bedding or seating product in the form of a mattress 10.

Although a mattress 10 is illustrated, the present invention may be used to construct any bedding or seating product. The mattress 10 comprises a pocketed spring assembly 12 having a generally planar top surface 14 in a top plane P1 and a parallel generally planar bottom surface 16 in a bottom plane P2. Covering pads 18 (only one being shown) may be located on the top and bottom surfaces 14, 16 of the pocketed spring assembly 12. An upholstered covering 20 encases the pocketed spring assembly 12 and the covering pads 18.

The mattress 10 has a height H defined as the distance between the top and bottom surfaces 14, 16 of the pocketed spring assembly 12. Similarly, the mattress 10 has a transverse dimension or width W defined between opposed side surfaces 22 and a longitudinal dimension or length L defined as the distance between the opposed end surfaces 24 of the mattress 10. The longitudinal dimension is illustrated as being larger than the transverse dimension of the mattress 10 although it is within the contemplation of the present invention that the longitudinal and transverse dimensions be identical, such as in a square product.

If desired, at least one border wire may be secured to the pocketed spring assembly 12 with hog rings or any other conventional fasteners. FIG. 1 illustrates an upper border wire 26 and a lower border wire 28, both of which are generally rectangular, secured to the pocketed spring assembly 12. However, only one border wire may be incorporated into the product, if desired. In any of the preferred embodiments of this invention, one or more border wires may be incorporated into the product.

Figure 2:
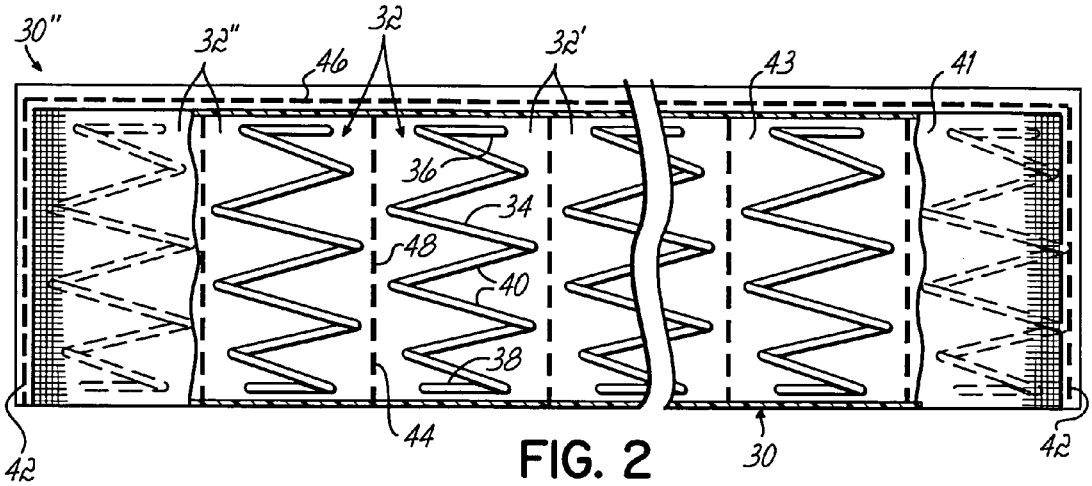
FIG. 2 is a cross-sectional view taken along line 2—2 of FIG. 1.
Figure 4:
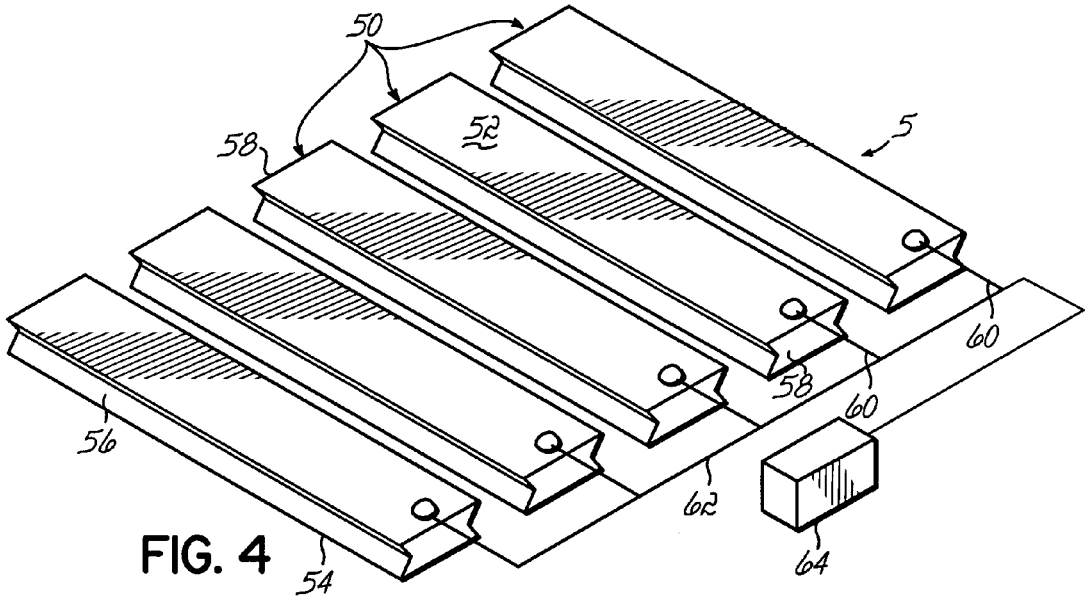
FIG. 4 is a perspective view of the air control system of the product of FIG. 1.

In one preferred embodiment of the present invention illustrated in FIG. 1, the pocketed spring assembly 12 comprises a plurality of transversely extending strings of springs 30 joined together in a manner shown in FIG. 4. FIG. 2 illustrates one of the strings of springs 30. Although one configuration of strings of springs 30 is illustrated, the strings of springs 30 may assume other configurations, shapes or sizes.

Referring to FIG. 2, each string of springs 30 comprises a row of interconnected fabric pockets 32. Each of the fabric pockets 32 contains at least coil spring 34 having an upper end turn 36, a lower end turn 38 and a plurality of central convolutions 40 between the end turns 36, 38. Preferably, only one piece of fabric is used to form a string of springs 30, the piece of fabric being folded over onto itself around the coil springs 34. As is known in the art, opposite sides or plies 41, 43 of the fabric are sewn, welded or otherwise secured together in order to create a pair of outermost seams 42, a plurality of internal seams 44 and a top seam 46. The internal seams 44 separate adjacent pockets 32 and therefore adjacent coil springs 34. Although the seams 42, 44 and 46 are illustrated as being a plurality of spaced, linear segments 48, they may comprise continuous lines or a series of dots or other arrangement without departing from the spirit of this invention.

Figure 3:
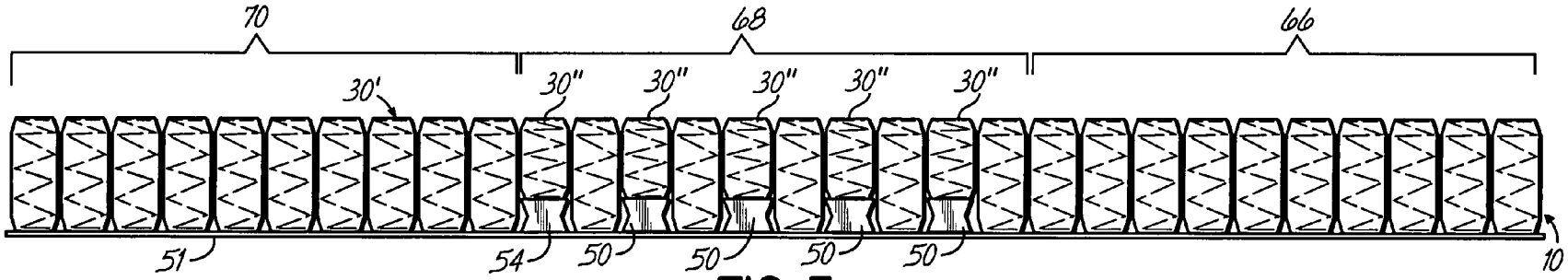
FIG. 3 is a cross-sectional view taken along line 3—3 of FIG. 1.

As best illustrated in FIGS. 3 and 4, the mattress 10 has a plurality of inflatable pneumatic bellows or members 50 extending in a transverse direction at select locations. Although five inflatable pneumatic members 50 are illustrated, the mattress 10 may have any number of inflatable pneumatic members at any desired locations. As illustrated in FIG. 4, each of the inflatable pneumatic members 50 has an upper surface 52, a lower surface 54, side surfaces 56 and end surfaces 58. Although one configuration of inflatable pneumatic member 50 is illustrated, the inflatable pneumatic members 50 may assume other shapes and configurations. The inflatable pneumatic members 50 may be constructed from a variety of materials such as neoprene, butyl rubber and the like. Optionally, the inflatable pneumatic members 50 may be covered exteriorly with a cloth cover (not shown) to reduce noise such as squeaking.

As shown in FIG. 4, an air supply system 5 includes an inflation tube or line 60 which extends from a supply line 62 to each of the inflatable pneumatic members 50. A pump 64 powered by a power source (not shown) and connected to an air supply (not shown) provides air through the supply line 62 and inflation lines 60 to the inflatable pneumatic members 50.

Referring to FIG. 3, each of the inflatable pneumatic members 50 is secured to a lower scrim sheet 51. More particularly, the lower surface 54 of each of the inflatable pneumatic members 50 is secured to a lower scrim sheet 51. Although the preferred method of securing each of the inflatable pneumatic members 50 to the lower scrim sheet 51 is with adhesive, any other method of securement may be used.

Referring to FIG. 3, each of the inflatable pneumatic members 50 extends transversely in a direction parallel the strings of springs 30. In the preferred embodiment illustrated in FIG. 3, some of the strings of springs 30' are secured to the lower scrim sheet 51 and do not have an inflatable pneumatic member 50 thereunder.

Although the preferred method of securing these strings of springs 30' to the lower scrim sheet 51 is with adhesive, any other method of securement may be used.

Other strings of springs 30" are located directly above inflatable pneumatic members 50 and secured thereto. The lower surfaces of these strings of springs 30" are secured to the upper surface 52 of the inflatable pneumatic members 50 located directly underneath the tranversely extending strings of springs 30".

Although the preferred method of securing these strings of springs 30" to the upper surface 52 of the inflatable pneumatic members 50 is with adhesive, any other method of securement may be used.

As shown in FIGS. 1 and 3, the pocketed spring assembly 12 of the mattress 10 is divided into multiple regions or sections as one moves longitudinally down the side of the mattress. At one end of the mattress 10 is a head section 66, immediately adjacent head section 66 is a center section 68, immediately adjacent center section 68 at the other end of mattress 10 is a foot section 70.

As illustrated in FIG. 3, in the preferred embodiment of product illustrated in FIGS. 1–3, the head section 66 of the mattress 10 comprises strings of springs 30' secured to the lower scrim sheet 51. The center section 68 of the mattress 10 comprises five spaced inflatable pneumatic members 50, strings of springs 30" located directly above the spaced inflatable pneumatic members 50 and secured thereto. The center section 68 of the mattress 10 further comprises several transversely extending strings of springs 30' secured to the lower scrim sheet 51. Like the head section 66 of the mattress 10, the foot section 70 of the mattress 10 comprises transversely extending strings of springs 30' secured to the lower scrim sheet 51. The head and foot sections 66, 70 have no inflatable members 50. Although five inflatable pneumatic members 50 are illustrated being in the center section 68 of the mattress 10, the mattress 10 may have any number of inflatable pneumatic members at any desired locations.

Figure 1A:
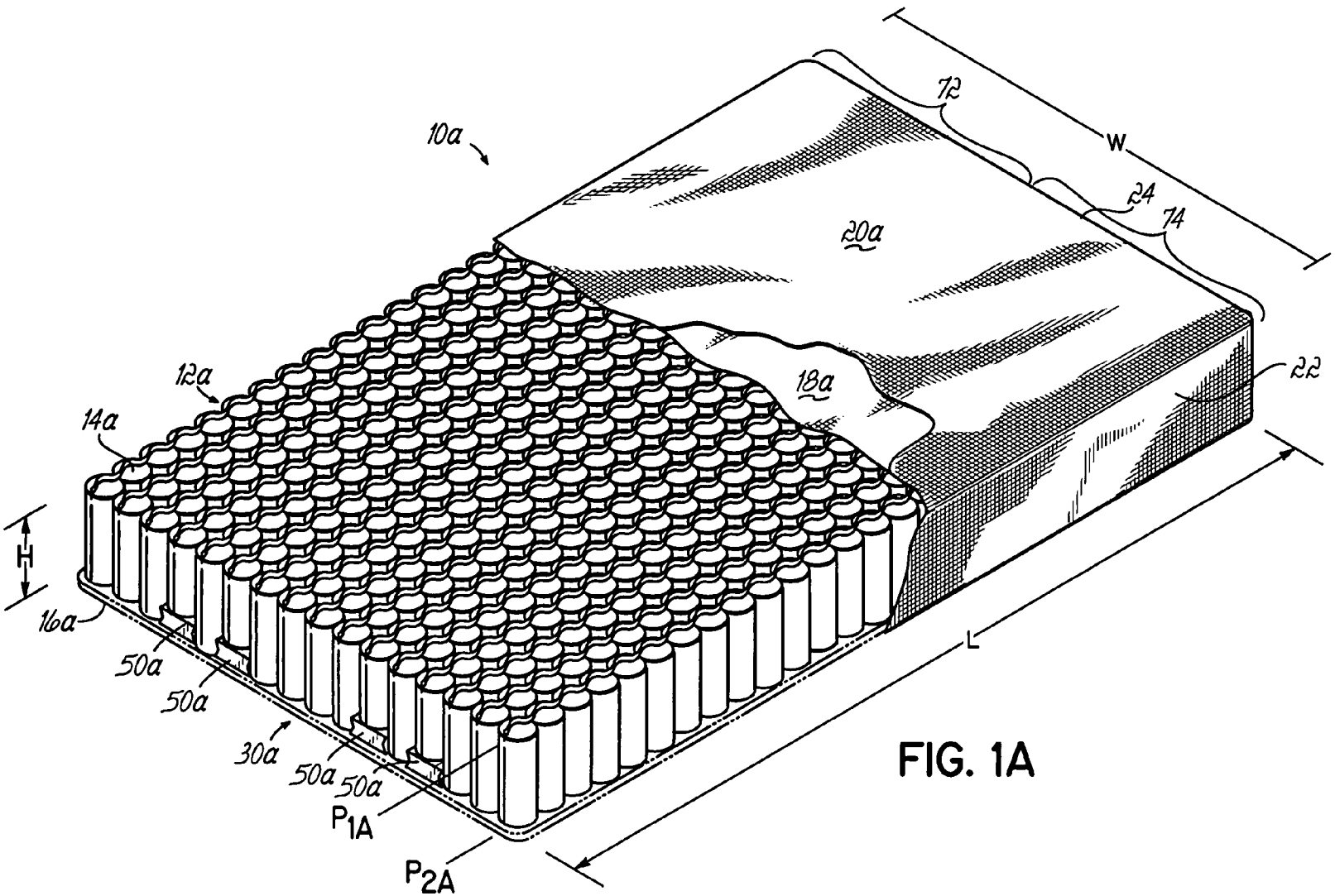
FIG. 1A is a perspective view of a bedding product made in accordance with another aspect of the invention comprising a pocketed spring assembly in which the strings of springs extend longitudinally.

FIG. 1A illustrates an alternative embodiment of the present invention. In this embodiment, the mattress **10*a* has a pocketed spring assembly 12*a* having a generally planar top surface 14*a* in a top plane P1A and a parallel generally planar bottom surface 16 in a bottom plane P2A. Covering pads 18*a* (only one being shown) may be located on the top and bottom surfaces 14*a*, 16*a* of the pocketed spring assembly 12*a*. An upholstered covering 20*a* encases the pocketed spring assembly 12*a* and the covering pads 18*a***.

The mattress 10*a* has a height H defined as the distance between the top and bottom surfaces 14*a*, 16*a* of the pocketed spring assembly 12*a*. Similarly, the mattress 10*a* has a transverse dimension or width W defined between opposed side surfaces 22*a* and a longitudinal dimension or length L defined as the distance between the opposed end surfaces 24*a* of the mattress 10*a*. The longitudinal dimension is illustrated as being larger than the transverse dimension of the mattress 10*a* although it is within the contemplation of the present invention that the longitudinal and transverse dimensions be identical, such as in a square product.

The pocketed spring assembly 12*a* comprises a plurality of longitudinally extending strings of springs 30*a* joined together. Each string of springs 30*a* comprises a plurality of pockets (not shown), each containing at least one spring (not shown) like the string of springs 30 shown in FIG. 2. However, any other configuration of string of springs may used in accordance with this preferred embodiment of the invention.

As best illustrated in FIG. 1A, the mattress 10*a* has a plurality of inflatable pneumatic bellows or members 50*a* extending in a longitudinal direction at select locations. Although four inflatable pneumatic members 50*a* are illustrated, the mattress 10*a* may have any number of inflatable pneumatic members at any desired locations. Due to inflation of the inflatable pneumatic members 50*a*, the mattress 10*a* may be divided into multiple regions or sections of differing firmness as one moves transversely along the end of the mattress 10*a*. Therefore, the mattress 10*a* may have a first section 72 and a second section 74. The inflatable pneumatic members 50*a* in one of the sections may be inflated to a greater degree than the inflatable pneumatic members 50*a* in the other section or sections to increase the firmness of one of the sections relative to the firmness of the other section or sections. Although this embodiment of the present invention is illustrated having two inflatable pneumatic members 50*a*, one per section, the mattress 10*a* may also be manufactured with any number of inflatable pneumatic members at any desired locations.

Figure 6:
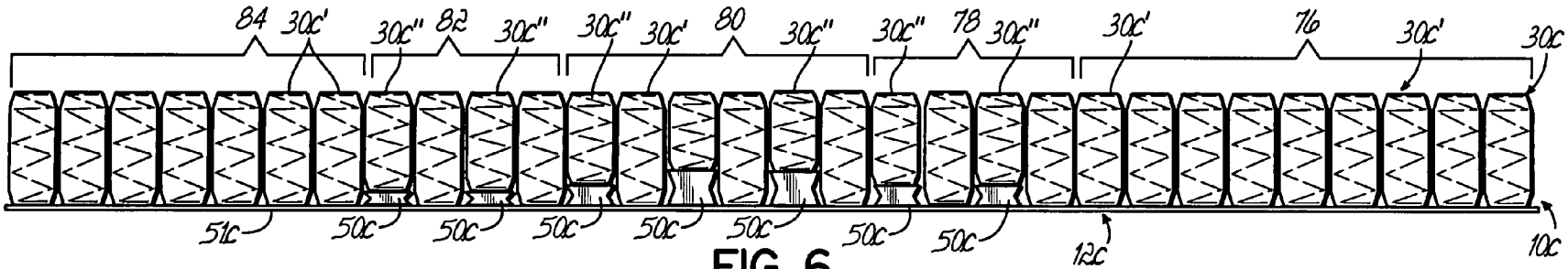
FIG. 6 is a side elevational view of an alternative preferred embodiment of the present invention.

FIG. 6 illustrates another preferred alternative embodiment of the present invention. In this preferred embodiment, the mattress 10*c* has a pocketed spring assembly 12*c* which is divided into multiple regions or sections as one moves longitudinally down the side of the mattress. At one end of the mattress 10*c* is a head section 76, immediately adjacent head section 76 is an upper lumbar section 78, immediately adjacent upper lumbar section 78 is a middle lumbar section 80, immediately adjacent middle lumbar section 80 is a lower lumbar section 82, and at the other end of mattress 10*c* is a foot section 84.

The pocketed spring assembly 12*c* comprises a plurality of transversely extending strings of springs 30*c*. Each string of springs 30*c*' in the head and foot sections 76, 84 is secured to a lower scrim sheet 51*c*. The head and foot sections 76, 84 of the pocketed spring assembly 12*c* has no inflatable pneumatic members.

In the upper lumbar section 78 of the pocketed spring assembly 12*c*, two strings of springs 30*c*' are secured directly to the lower scrim sheet 51*c*. Two other strings of springs 30*c*" are secured to an inflatable pneumatic member 50*c*. Although FIG. 6 illustrates every other string of springs 30*c*" in the upper lumbar section 78 having an inflatable pneumatic member 50*c* under it, the upper lumbar section 78 may have any number of inflatable pneumatic members 50*c* in any desired locations.

In the middle lumbar section 80 of the pocketed spring assembly 12*c*, two strings of springs 30*c*' are secured directly to the lower scrim sheet 51*c*. Four other strings of springs 30*c*" (two on each side of strings of springs 30*c*') are secured to two inflatable pneumatic members 50*c*. Although FIG. 6 illustrates every other string of springs 30*c*" in the middle lumbar section 80 having an inflatable pneumatic member 50*c* under it, the middle lumbar section 80 may have any number of inflatable pneumatic members 50*c* in any desired locations.

In the lower lumbar section 82 of the pocketed spring assembly 12*c*, two strings of springs 30*c*' are secured directly to the lower scrim sheet 51*c*. Two other strings of springs 30*c*" are secured to inflatable pneumatic members 50*c* which are secured to lower scrim sheet 51*c*. Although FIG. 6 illustrates every other string of springs 30*c*" in the lower lumbar section 82 having an inflatable pneumatic member 50*c* under it, the lower lumbar section 82 may have any number of inflatable pneumatic members 50*c* in any desired locations.

In the pocketed spring assembly 12*c*, each of the inflatable pneumatic members 50*c* is secured to the lower scrim sheet 51*c*.

In the preferred embodiment illustrated in FIG. 6, any of the sections may have any number of inflatable pneumatic members at any desired locations. Similarly, as shown in FIG. 6, in this preferred embodiment, like any other preferred embodiment, the inflatable pneumatic members 50*c* may be inflated to varying degrees to change the preload of the pocketed springs thereabove. Therefore, the lumbar sections 78, 80 and 82 may be made firmer than the head and foot sections 76, 80 by inflating the pneumatic members 50*c*. Although the strings of springs 30*c* are illustrated as being transversely extending, this embodiment of the present invention, like the other embodiments, may have longitudinally extending strings of springs.

Figure 7:
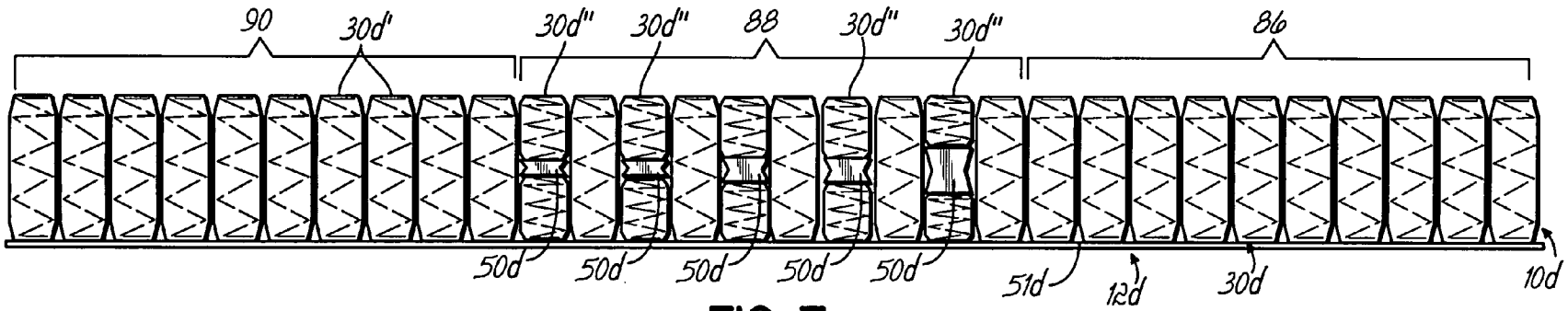
FIG. 7 is a side elevational view of an alternative preferred embodiment of the present invention.

FIG. 7 illustrates another preferred alternative embodiment of the present invention. This preferred embodiment is referred to in the industry as a two-sided product which may be used on either side. In this preferred embodiment, the mattress 10*d* has a pocketed spring assembly 12*d* which is divided into multiple regions or sections as one moves longitudinally down the side of the mattress. At one end of the mattress 10*d* is a head section 86, immediately adjacent head section 86 is an center section 88, immediately adjacent center section 88 is a foot section 90.

The pocketed spring assembly 12*d* comprises a plurality of transversely extending strings of springs 30*d*. Each string of springs 30*d*'in the head and foot sections 86, 90 is secured to a lower scrim sheet 51*d*. Thus, there are no inflatable pneumatic members in the head and foot sections 86, 90. Although four strings of springs 30*d*' are secured directly to the lower scrim sheet 51*d* in the head and foot sections 86, 90 of the pocketed spring assembly 12*d*, any number of strings of springs 30*d*' may be secured to the lower scrim sheet 51*d*.

In the center section 88 of the pocketed spring assembly 12*d* are located five inflatable pneumatic members 50*d* sandwiched between strings of springs 30*d*". Although only one scrim sheet 51*d* is illustrated in FIG. 7, another scrim sheet (shown in dashed lines) may be secured to the opposite surface of the product 10*d*. Strings of springs 30*d*" are secured to both the upper and lower surfaces of the inflatable pneumatic members 50*d*. Each of the strings of springs 30*d*" below the inflatable pneumatic members 50*d* in the center section 88 of the pocketed spring assembly 12*d* is secured to the lower scrim sheet 51*d*. Although five inflatable pneumatic members 50*d* are illustrated in the center section 88 of the pocketed spring assembly 12*d*, any number of inflatable pneumatic members 50*d* may be located in any of the sections of the pocketed spring assembly 12*d*. Although the strings of springs 30*d* are illustrated as being transversely extending, this embodiment of the present invention may have longitudinally extending strings of springs.

Figure 8:
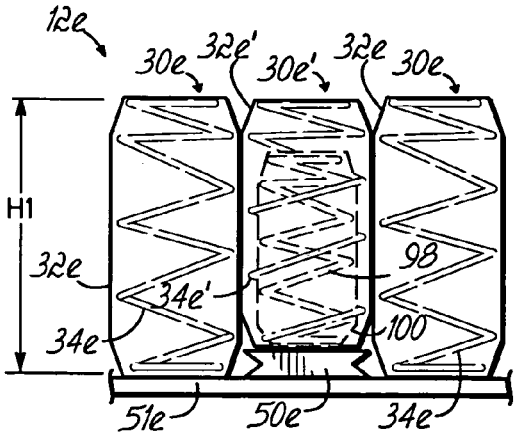
FIG. 8 is a side elevational view of a portion of a string of springs of an alternative preferred embodiment of the present invention.
Figure 9:
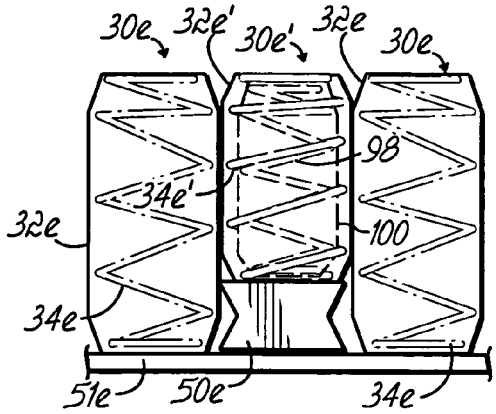
FIG. 9 is a side elevational view of the portion of the string of springs of FIG. 8 with the inflatable member inflated.

FIGS. 8 and 9 illustrate another preferred alternative embodiment of the present invention. FIG. 8 illustrates a portion of a pocketed spring assembly 12*e* used in this preferred embodiment. In this preferred embodiment strings of springs 30*e* comprise pockets 32*e* in which are located tall coil springs 34*e* of a first height H1.

The fabric pockets 32*e* of these strings of springs 30*e* are secured to a lower scrim sheet 51*e*. There are no inflatable members underneath strings of springs 30*e*. However, the pocketed spring assembly 12*e* further comprises strings of springs 30*e*' underneath which is an inflatable pneumatic member 50*e* secured to a scrim sheet 51*e*. Each of the pockets 32*e*'of strings of springs 30*e*' contains a coil spring 34*e*' of a first height H1 and a second coil spring 98 of a second height less than the first height. The second coil spring 98 is contained within its own fabric pocket 100.

As shown in FIG. 9, when the inflatable member 51*e* is inflated, the second coil spring 98 in its pocket 100 raises to the top of the pocket 32*e*', thereby increasing the firmness of the string of springs 30*e*'. In this manner, select strings of springs may be made firmer than other strings of springs by supplying air to the inflatable member or members 50*e*. The force exerted by the inflated member 50*e* causes the second pocketed springs 98 to raise upwardly to the top of the pockets 32*e*' of the strings of springs 30*e*'. Although this preferred embodiment is illustrated as being used in a one-sided product, this preferred embodiment may be incorporated into a two-sided product. In place of second pocketed springs 98, other objects such as cylinders of foam may be incorporated into the pockets of select springs of springs above inflatable members so that upon inflation these object are forced outwardly to increase the firmness of portions of the product.

Figure 5:
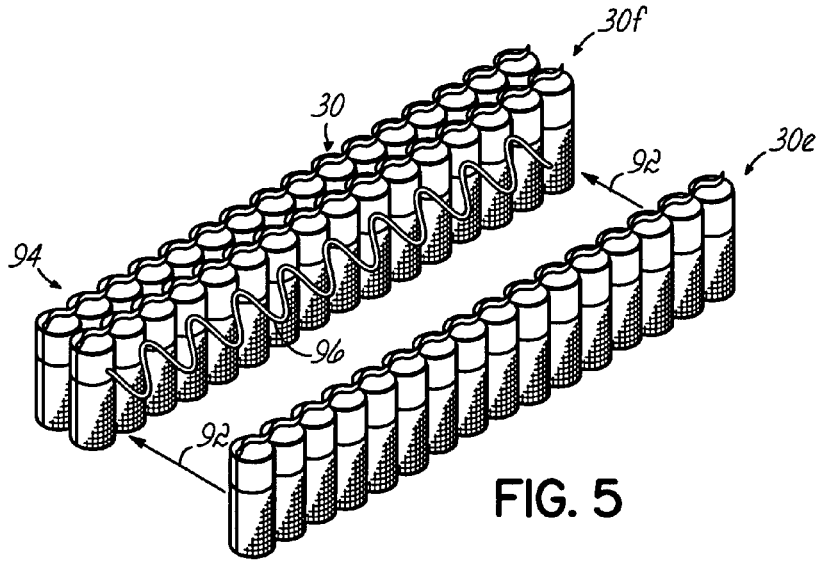
FIG. 5 is a perspective view of a string of springs being joined to a portion of a pocketed spring assembly.

One method of manufacturing the bedding or seating product 10 is partially illustrated in FIG. 5. This method comprises joining a plurality of parallel string of springs 30 to each other to form a pocketed spring assembly 12. Referring to FIG. 5, a string of springs 30*e* is moved in the direction of arrows 92 until it abuts an outermost string of springs 30*f* which is part of a subassembly 94 made of a plurality of strings of springs (two being shown). A sinuous-shaped glue line 96 is placed on the outer surface of the fabric of the string of springs 30*f*. When string of springs 30*e* abuts against the string of springs 30*f*, pressure is applied and the glue or adhesive is allowed to dry, thus securing the string of springs 30*e* to the string of springs 30*f*. Although a sinuous-shaped line of glue is illustrated and described, the glue may assume other shapes and configurations such as individual dots or a plurality of linear segments, for example. Other attachment methods such as hog rings, welds or any other type of fastener may be used to secure adjacent strings of springs to each other.

The pocketed spring assembly 12 is then joined to one or more scrim sheets 51 adhesively or via any other suitable method. As desired, one or more inflatable pneumatic members 50 are sandwiched between the scrim sheet(s) 51 and some of the strings of springs 30 of the pocketed spring assembly 12. The inflatable pneumatic members 50 are then inflated to the desired degree. Lastly, an upholstered covering 20 is placed around the pocketed spring assembly 12, scrim sheet or sheets 51 and inflatable pneumatic member or members 50.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A bedding or seating product comprising:

a pocketed spring assembly comprising a plurality of parallel strings of springs joined to each other, each of said strings of springs comprising a row of interconnected pockets, each of said pockets containing at least one spring encased in fabric;

inflatable members located underneath select portions of strings of springs, each of said inflatable members being of a width equal to one of said string of springs; and an upholstered covering surrounding said pocketed spring assembly.

2. A bedding or seating product comprising:

a pocketed spring assembly comprising a plurality of parallel strings of springs joined to each other, each of said strings of springs comprising a row of interconnected pockets, each of said pockets containing at least one spring encased in fabric; and inflatable members located underneath select portions of strings of springs, each of said inflatable members being of a width equal to one of said string of springs.

3. The product of claim 2 wherein the strings of springs extend longitudinally.

4. The product of claim 2 wherein the strings of springs extend transversely.

5. The product of claim 2 wherein each of the springs is a coil spring having an upper end turn, a lower end turn and a plurality of central convolutions between said end turns.

6. A bedding or seating product comprising:

a pocketed spring assembly comprising a plurality of parallel strings of springs joined to each other, each of said strings of springs comprising a row of interconnected fabric pockets, each of said pockets containing at least one spring encased therein, wherein said pocketed spring assembly has multiple regions of differing firmness due to inflatable members being sandwiched between a scrim sheet and select portions of strings of springs such that the firmness of the select portions of strings of springs may be adjusted.

7. The product of claim 6 wherein the strings of springs extend longitudinally.

8. The product of claim 6 wherein the strings of springs extend transversely.

9. The product of claim 6 wherein said scrim sheet is secured to some of said strings of springs and secured to said inflatable members.

10. A bedding or seating product comprising:

a pocketed spring assembly comprising a plurality of parallel strings of springs joined to each other, each of said strings of springs being made of one piece of fabric formed into multiple interconnected pockets, each of said pockets containing at least one spring encased therein, wherein said pocketed spring assembly has multiple sections of increased firmness relative to the firmness of other sections of said pocketed spring assembly, the sections of increased firmness being attributable to inflatable members sandwiched between a scrim sheet and selected portions of the strings of springs of said sections of increased firmness.

11. The product of claim 10 wherein each of said springs has an upper end turn, a lower end turn and a plurality of central convolutions between said end turns.

12. The product of claim 10 wherein said inflatable members are connected to an air pump.

13. A bedding or seating product comprising:

a pocketed spring assembly comprising a plurality of parallel strings of springs joined to each other, each of said strings of springs comprising a plurality of interconnected pockets, each of said pockets containing at least one spring encased therein, inflatable pneumatic members to located below the pockets of select strings of springs, each of said inflatable members being of a width equal to one of said string of springs, whereby the inflatable pneumatic members may be inflated to increase the firmness of portions of said pocketed spring assembly.

14. The product of claim 13 wherein the strings of springs extend longitudinally.

15. The product of claim 13 wherein the strings of springs extend transversely.

16. The product of claim 13 wherein each of said springs has an upper end turn, a lower end turn and a plurality of central convolutions between said end turns.

17. A bedding or seating product comprising:

a pocketed spring assembly comprising a plurality of parallel strings of springs joined to each other, each of said strings of springs comprising a row of interconnected pockets, each of said pockets containing at least one spring encased in fabric; and inflatable members located underneath select strings of springs, each of said inflatable members being of a width equal to one of said string of springs, wherein upon inflation said inflatable member raises one of said springs in said fabric pocket relative to the other of said springs.

18. A method of adjusting the firmness of a portion of a bedding or seating product, said method comprising:

securing together multiple string of springs into a pocketed spring assembly;

providing inflatable members sandwiched between a sheet and portions of said pocketed spring assembly; and inflating at least one of said inflatable members to preload select pocketed springs of said pocketed spring assembly.

19. The method of claim 18 further comprising inflating said at least one of said inflatable members with an air pump.

20. A method of manufacturing a bedding or seating product comprising:

joining a plurality of strings of springs to adjacent strings of springs to form a pocketed spring assembly;

securing a scrim sheet to some of said strings of springs;

securing inflatable members to said scrim sheet and to some of said strings of springs such that said inflatable members are sandwiched therebetween; and inflating the inflatable members.

21. The method of claim 20 further comprising encasing the pocketed spring assembly, scrim sheet and inflatable members in a fabric covering.

22. A method of posturing a bedding or seating product, said method comprising:

securing together multiple string of springs into a pocketed spring assembly;

providing inflatable members underneath portions of said pocketed spring assembly, each of said inflatable members being of a width equal to one of said string of springs; and inflating said inflatable members to reposition springs located inside select pocketed springs of said pocketed spring assembly.

23. The method of claim 22 wherein said inflatable members are inflated with air.

* * * * *

UNITED STATES PATENT AND TRADEMARK OFFICE

CERTIFICATE OF CORRECTION

PATENT NO. : 6,986,182 B2
DATED : January 17, 2006
INVENTOR(S) : Niels S. Mossbeck It is certified that error appears in the above-identified patent and that said Letters Patent is hereby corrected as shown below:

Column 2,
Line 23, “pockets of a strings” should be -- pockets of strings --.

Column 3,
Line 43, “Due the presence” should be -- Due to the presence --.

Column 4,
Line 62, “Although a mattress” should not begin a new paragraph.

Column 6,
Lines 22 and 31, “Although the preferred” should not begin new paragraphs.

Column 7,
Line 57, “has no inflatable” should be -- have no inflatable --.

Column 8,
Line 45, “an center” should be -- a center --.

Column 9,
Line 14, “The fabric pockets” should not begin a new paragraph.
Line 37, “springs of springs” should be -- strings of springs --.
Line 43, “string of springs” should be -- strings of springs --.

Column 11,
Line 17, “members to located” should be -- members located --.

UNITED STATES PATENT AND TRADEMARK OFFICE

CERTIFICATE OF CORRECTION

PATENT NO. : 6,986,182 B2
DATED : January 17, 2006
INVENTOR(S) : Niels S. Mossbeck It is certified that error appears in the above-identified patent and that said Letters Patent is hereby corrected as shown below:

Column 12,
Lines 3 and 27, "string of springs" should be -- strings of springs --.

Signed and Sealed this

Second Day of May, 2006

JON W. DUDAS
*Director of the United States Patent and Trademark Office*